United States Patent [19]

Barnert et al.

[11] 4,122,813

[45] Oct. 31, 1978

[54] INJECTION TIMING ADJUSTMENT APPARATUS

[75] Inventors: Konrad Barnert; Günter Stein, both of Wolfsburg, Fed. Rep. of Germany

[73] Assignee: Volkswagenwerk Aktiengesellschaft, Fed. Rep. of Germany

[21] Appl. No.: 686,010

[22] Filed: May 13, 1976

[30] Foreign Application Priority Data

May 16, 1975 [DE] Fed. Rep. of Germany ..... 2521827

[51] Int. Cl.[2] ..... F02D 1/16

[52] U.S. Cl. ..... 123/139 ST; 123/139 AQ; 123/179 L

[58] Field of Search ..... 123/139 AP, 139 AQ, 123/179 C, 179 G, 179 L, 139 ST

[56] References Cited

U.S. PATENT DOCUMENTS

| | | | |
|---|---|---|---|
| 2,063,848 | 12/1936 | Meyer et al. | 123/139 AQ X |
| 2,372,180 | 3/1945 | Edwards | 123/139 AQ X |
| 3,089,475 | 5/1963 | Kohler et al. | 123/139 ST X |
| 3,494,288 | 2/1970 | Watson | 123/139 AQ X |

FOREIGN PATENT DOCUMENTS

| | | | |
|---|---|---|---|
| 681,668 | 10/1952 | United Kingdom | 123/139 AQ |

*Primary Examiner*—Martin P. Schwadron
*Assistant Examiner*—Richard Gerard
*Attorney, Agent, or Firm*—Brumbaugh, Graves, Donohue & Raymond

[57] ABSTRACT

An apparatus, for adjusting the timing of a fuel injection pump for an internal combustion engine, advances the timing in response to supplied pressure which is proportional to the speed of the engine, and also advances the injection timing when the engine is cold.

10 Claims, 3 Drawing Figures

Fig.2
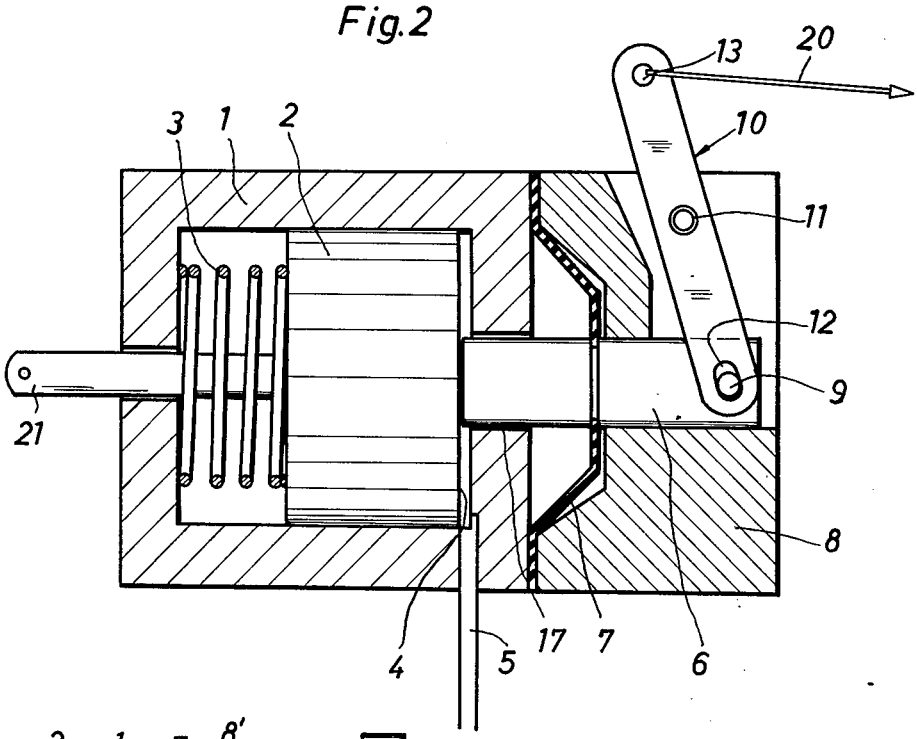
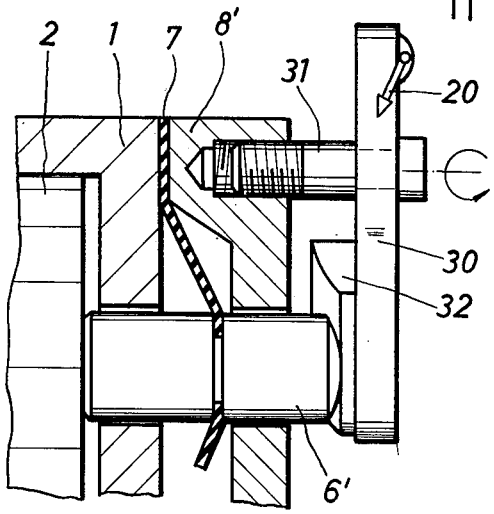
Fig.3

INJECTION TIMING ADJUSTMENT APPARATUS

BACKGROUND OF THE INVENTION

This invention relates to fuel injection pumps for internal combustion engines and particularly to such pumps wherein injection timing is adjusted in accordance with the operating conditions of the engine.

In a fuel injected engine, particularly a compression ignition or diesel internal combustion engine, it is desirable to adjust the injection timing in accordance with the operating conditions of the engine. Adjustment of the injection timing is desirable in accordance with the operating speed of the engine, in particular injection timing should be advanced as engine speed is increased. In addition to the speed proportional adjustment of the injection timing, it is desirable to additionally have an advancement of the injection timing during initial engine operation until the engine has reached its normal operating temperature.

Devices have been known which automatically adjust the injection timing of a fuel injection pump in accordance with the operating speed of the engine. Such devices make use of a piston in a cylinder which is acted upon by pressure in opposition to a spring. The pressure supplied is proportional to the speed of the engine and upon increased speed of the engine moves the piston against the spring thereby advancing the timing of the fuel injection pump through a connection between the piston and the injection pump.

There have been prior art devices for advancing the timing of an engine when the engine is cold. Such a device is disclosed in German published patent application No. 1,143,675. The advancement mechanism disclosed in that application makes use of a pressure cylinder within which there are coaxially mounted two pistons. The inner piston, upon stopping of the engine, assumes a position which advances the fuel injection timing and remains in this position during the engine starting period, independent of the operating temperature of the engine. This prior art device acts independent of engine temperature and advances the injection timing, even when the engine is being started warm. In this event, the unwarranted advancement of the injection timing results in an unfavorable combustion process with rough and noisy engine operation.

It is therefore an object of the present invention to provide a new and improved apparatus for adjusting the injection timing of fuel injection pump.

It is a further object of the present invention to provide such an apparatus which advances the injection timing when the engine temperature is below the normal operating temperature.

STATEMENT OF THE INVENTION

In accordance with the present invention, there is provided an apparatus for adjusting the injection timing of an internal combustion engine fuel injection pump in response to supplied pressure, proportional to the speed of the engine. The apparatus includes a cylinder and a piston movable within the cylinder in response to the supplied pressure for advancing the injection timing. There is also provided a spring urging the piston against the supplied pressure and means for moving the piston independent of the supplied pressure to advance the timing when the engine is cold.

In accordance with preferred embodiments of the invention, the means for moving the piston may be made responsive to the temperature of the engine. There may be provided an electrically heated thermostat which is connected or disconnected to a power supply along with a preliminary engine heating device. The means for moving the piston may include a plunger mounted to the cylinder coaxial to the piston and acting upon the piston in opposition to the spring. The plunger may be manually operated by an arrangement which includes a lever and a cable for actuating the lever, or may be alternately activated by a slide ramp mounted on a rotating plate.

For a better understanding of the present invention, together with other and further objects, reference is made to the following description, taken with accordance with the accompanying drawings, and its scope will be pointed out in the independent claims.

BRIEF DESCRIPTION OF THE DRAWINGS

FIG. 2 is a cross sectional view of another injection timing adjustment apparatus in accordance with the invention.

FIG. 3 is a partial cross sectional view of the apparatus of FIG. 2 illustrating an alternate activating mechanism.

DESCRIPTION OF THE INVENTION

Figure 1:
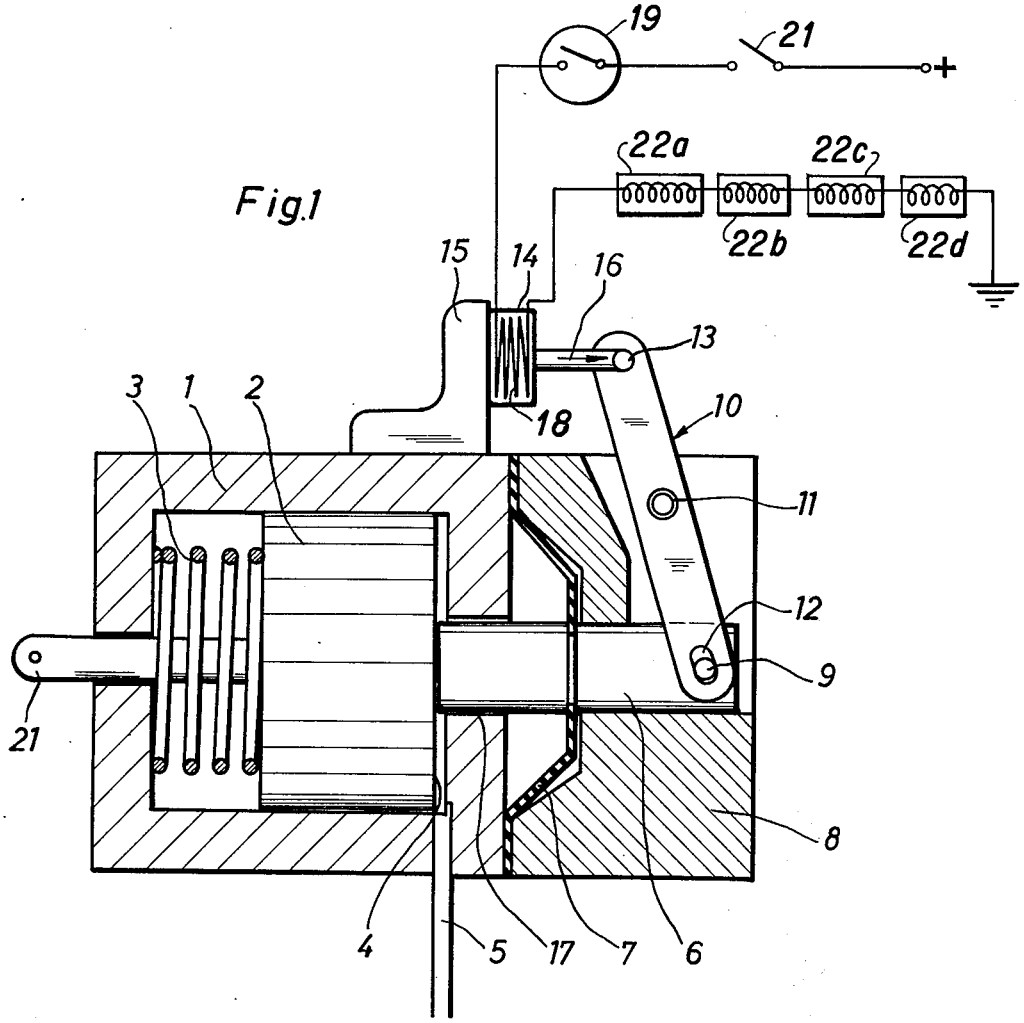
FIG. 1 is a cross-sectional view of an injection pump timing adjustment apparatus in accordance with the present invention.

FIG. 1 is a cross sectional view of an apparatus for adjusting the timing of a fuel injection pump in accordance with the present invention. Illustrated in FIG. 1 is a cylinder 1 within which there is mounted a piston 2. A spring 3 urges the piston toward a pressure chamber 4. Pressure which is proportional to the speed of the engine is supplied over pressure line 5 to pressure chamber 4 to move the piston against spring 3. Interconnecting rod 21, which is attached to piston 2 may be attached to a fuel injection pump in a manner to adjust the pump timing in response to movements of piston 2. Under normal operating conditions, the speed representative pressure supplied to pressure chamber 4 over pressure line 5 moves piston 2 and rod 21 in accordance with the speed of the engine thereby to adjust the injection timing to advance the timing upon increased engine operating speed.

The apparatus illustrated in FIG. 1 additionally contains a plunger 6 which is mounted to cylinder 1 coaxial to piston 2 and passes through a bore 17 in the head of the cylinder. A sealing diaphragm 7 is provided to prevent escape of pressure from chamber 4 through bore 17. A guide block 8 is provided to guide the motion of plunger 6. There is provided a lever 10 which is pivoted on axis 11 and coupled to plunger 6 by pin 9 which passes through slot 12 in lever 10. The other end of lever 10 is connected to actuating rod 16 at pivot point 13. Rod 16 is connected to thermostat 14 which is mounted to cylinder 1 by support 15.

When the internal combustion engine, with which the apparatus of FIG. 1 operates, is being started in a cold condition, an electrical current is provided to a heating element 18 in thermostat 14 causing the thermostat to expand pushing against rod 16 which causes lever 10 to pivot pressing plunger 6 into cylinder 1 and against piston 2. Plunger 6 moves piston 2 against spring 3 thereby causing rod 21 to advance the timing of the fuel injection pump. When the engine reaches operating temperature the current to the heating element 18 in thermostat 14 is disconnected and thermostat 14 contracts causing plunger 6 to withdraw from cylinder 1. When plunger 6 is withdrawn from cylinder 1 piston 2 is free to operate in accordance with the pressure supplied to chamber 4.

The heating element 18 in thermostat 14 may be conveniently connected to the same circuit which provides for preheating of the heater plugs *22a–22b* in the internal combustion engine. Such preheating devices are commonly used in diesel engines to heat the combustion chambers to enable spontaneous ignition when the engine is cold. The preheaters in the engine are disconnected by the opening of thermostat switch 19, which is connected in series with ignition or heat plug switch 21, when the engine reaches operating temperature. Thermostat switch 19 may sense the temperature of the engine by contact with the cooling fluid or oil.

It is alternately possible to provide a solenoid as the activating device instead of the electrically heated thermostat 14 illustrated in FIG. 1. Another possibility is to provide for manual activation of plunger 6 so that the injection timing may be manually advanced under cold starting condition by the operator in the same manner as a manually operated choke. FIG. 2 illustrates an embodiment of the invention wherein there is provided a cable 20 connected to lever 10 which may lead to a control on the dashboard of the vehicle for manually advancing the injection timing of the engine.

FIG. 3 shows an alternate manual advancement mechanism. The FIG. 3 embodiment is provided with a plate 30, which rotates on an axis 31 fixed to the guide block 8', and is provided with an inclined ramp 32, which on rotation of plate 30 acts on plunger 6', moving plunger 6' into contact with cylinder 2 and thereby advancing the injection timing. Plate 30 may be conveniently rotated by use of a cable 20 which may be connected to a control on the dashboard of the vehicle.

Those skilled in the art will recognize that many variations may be made to the activating mechanism. For example, plunger 6 may be acted on directly by a solenoid or thermostat, rather than being activated on by a lever. It will be recognized that in all cases it is possible to manually or automatically advance the injection timing of the fuel pump in accordance with the temperature of the engine. When the engine is started in a warm condition, no advancement takes place either manually or automatically since such advancement is not necessary.

While there have been described what are believed to be the preferred embodiments of the invention, those skilled in the art will recognize that other and further modifications may be made thereto without departing from the true spirit of the invention, and it is intended to claim all such embodiments as fall within the true scope of the invention.

We claim:

1. Apparatus for adjusting the injection timing of an internal combustion engine fuel injection pump in response to supplied pressure proportional to the speed of said engine, comprising:

a cylinder;

a piston, movable within said cylinder in response to said supplied pressure, for advancing said injection timing in response to said supplied pressure;

a spring urging said piston against said pressure;

engaging means, movable between a first and a second position, for engaging said piston in said first position to move said piston against said spring to advance said timing independent of said supplied pressure and for disengaging said piston in said second position to permit said piston to operate freely in response to said supplied pressure;

and means for moving said engaging means to said first position during cold starting of said engine, and moving said engaging means to said second position during normal engine operation.

2. Apparatus as specified in claim 1 wherein said means for moving said engaging means comprises means responsive to the temperature of said engine.

3. Apparatus as specified in claim 2 wherein said means for moving said engaging means includes a thermostat having an electric heating element.

4. Apparatus as specified in claim 3 wherein, the heating element of said thermostat is coupled to a preliminary heating device of the heater plugs of said engine.

5. Apparatus as specified in claim 3 wherein the heating element of said thermostat is connected and disconnected in accordance with the temperature of said engine.

6. Apparatus as specified in claim 1 wherein said means for moving said engaging means includes a plunger, mounted to said cylinder coaxial to said piston, which acts on said piston in opposition to said spring.

7. Apparatus as specified in claim 6 wherein said means for moving said engaging means further comprises a lever acting on said plunger and a cable for actuating said lever.

8. Apparatus as specified in claim 6 wherein said means for moving said engaging means further comprises a slide ramp, mounted on a rotating plate, and acting on said plunger.

9. Apparatus as specified in claim 8 wherein said means for moving said engaging means further includes a cable for actuating said rotating plate.

10. Apparatus as specified in claim 1 wherein said means for moving said engaging means is manually operated.

* * * * *

UNITED STATES PATENT OFFICE

CERTIFICATE OF CORRECTION

Patent No. 4,122,813 Dated October 31, 1978

Inventor(s) Barnert et al.

It is certified that error appears in the above-identified patent and that said Letters Patent are hereby corrected as shown below:

Column 3, line 8, "22b" should be --22d--;
Claim 6, line 2, "moving said engaging means" should read --engaging said piston--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*